US006220376B1

(12) United States Patent
Lundell

(10) Patent No.: US 6,220,376 B1
(45) Date of Patent: Apr. 24, 2001

(54) DRILL BIT AND BUTTON

(75) Inventor: Lars-Gunnar Lundell, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/443,312

(22) Filed: Nov. 19, 1999

(30) Foreign Application Priority Data

Nov. 20, 1998 (SE) ..... 9803997

(51) Int. Cl.[7] ..... E21B 10/08
(52) U.S. Cl. ..... 175/430; 175/431
(58) Field of Search ..... 175/426, 430, 175/428, 431, 434, 378

(56) References Cited

U.S. PATENT DOCUMENTS 4,109,737 * 8/1978 Bovenkerk ..... 175/430
5,335,738 8/1994 Waldenström et al. .
5,379,854 1/1995 Dennis .
5,575,342 11/1996 Hedlund et al. .
6,003,623 * 12/1999 Miess ..... 175/430
6,053,263 * 4/2000 Meiners ..... 175/331
6,135,219 * 10/2000 Scott ..... 175/432

FOREIGN PATENT DOCUMENTS

2180280 * 8/1986 (GB) ..... 175/426
791-889 * 12/1977 (SU) ..... 175/426
1344-888 * 1/1986 (SU) ..... 175/426

* cited by examiner

*Primary Examiner*—Frank S. Tsay
(74) *Attorney, Agent, or Firm*—Burns, Doane, Swecker & Mathis, L.L.P.

(57) ABSTRACT

A drill bit has a plurality of cemented carbide buttons embedded in a front end of the drill body. Each button includes a cemented carbide body having a rear mounting portion embedded in the drill body, and a symmetrically shaped crushing end protruding from the drill body. The buttons are oriented at a first acute angle of from about 35° to about 55° relative to the rotational center axis of the drill bit. The crushing end of the button includes at least one annular groove defining axially spaced local maximum points at each side of the groove. An imaginary line touching the maximum points defining a second acute angle relative to the center line of the button. The second angle is smaller than the first acute angle.

11 Claims, 5 Drawing Sheets

DRILL BIT AND BUTTON

FIELD OF THE INVENTION

The present invention relates to drilling, such as rock drilling, and relates in particular to a drill bit and a button for such drilling.

TECHNICAL BACKGROUND

Diamond enhanced buttons (DE-buttons) for percussive drilling and rotary drilling usually have semispherical, ballistical, conical or chisel shaped tips. The outer hard polycrystalline diamond layer (PCD-layer) is very thin, normally 0.2 mm and the service length of the button is directly related to how fast the PCD-layer is worn through. To get the most from the DE-buttons the DE-bits normally are designed to distribute the wear as evenly as possible, i.e. the gauge buttons that often are determining the service length are placed symmetrically and also the bit as a whole often has a more or less symmetrical shape, such as shown in Hedlund et al. U.S. Pat. No. 5,575,342. A way to increase the service length would be to increase the thickness of the PCD-layer. However, for technical and physical reasons it has not been possible to make the PCD-layer much thicker than 0.4 mm on semispherical buttons for percussive and rotary drilling.

DE-button bits are most useful when drilling in hard to extra hard abrasive rock where DE-button bits have the advantage that they do not need to be reground, while the wear on conventional cemented carbide-buttons is high, requiring regrinding several times.

U.S. Pat. No. 5,335,738 discloses a button of cemented carbide with a stud covered by a diamond layer. The PCD layer is thicker at certain parts of the button, for example at the tip point where a shallow hole in the substrate is provided and on the flank wherein a shallow groove around the semispherical tip is provided. The known button has a layer which provides less disadvantageous stresses and locally thicker PCD-layer. The service length of the known button has, in spite of these improvements, not been optimized. Dennis U.S. Pat. No. 5,379,854 discloses in one embodiment a button of cemented carbide with a diamond layer. The button surface has a sinusoidal cross section and an applied PCD-layer of similar contour. The ridges and the grooves of the sinusoidal contour of the cemented carbide button serve to prevent delamination of the PCD-layer and reduce the shear stresses in the bond zone between the PCD-layer and the cemented carbide. The sinusoidal profile of the PCD-layer provides several impact points which work simultaneously when the button is used for drilling.

OBJECTS OF THE INVENTION

An object of the present invention is to provide a drill bit for percussive or rotary crushing rock drilling, wherein the service life of the bit is extended.

Another object of the present invention is to provide a button for a drill bit for percussive or rotary crushing rock drilling, wherein the service life of the button is extended.

Another object of the present invention is to provide a button and a drill bit for percussive or rotary crushing rock drilling, which provides for a faster penetration rate.

Still another object of the present invention is to provide a button for percussive or rotary crushing rock drilling, in which the geometry provides for beneficial displacement of the most active portion of the working end of the button.

SUMMARY OF THE INVENTION

These and other objects of the present invention have been attained by a drill bit which comprises a drill body having a connection section at a rear end thereof for connection to a drilling unit. The connection section defines a rotational center axis of the drill bit. The bit body further includes a plurality of buttons embedded in a front end of the drill body. Each button has a longitudinal center line. Each button comprises a cemented carbide body having a rear mounting portion embedded in the drill body, and a crushing end protruding from the drill body and being shaped symmetrically about the center line. Each button is oriented at a first acute angle of from about 35° to about 55° relative to the rotational center axis of the drill bit. The crushing end of each button comprises at least one annular groove arranged coaxially about the center line, whereby the crushing end includes local maximum points spaced apart by the groove. An imaginary line touching the maximum points defines a second acute angle relative to the center line of the button, the second acute angle being smaller than the first acute angle.

The invention also pertains to a button for a drill bit. The button comprises a cemented carbide body having a rear mounting portion defining a longitudinal center line, and a crushing end shaped symmetrically about the center line. The crushing end of the button comprises at least one annular groove arranged coaxially with the center line, whereby the crushing end includes local maximum points spaced axially apart by the groove. An imaginary line intersecting the maximum points defines an acute angle relative to the center line.

DESCRIPTION OF THE DRAWINGS

The objects and advantages of the invention will become apparent from the following detailed description of a preferred embodiment thereof in connection with the accompanying drawings, and in which.

DETAILED DESCRIPTION OF PREFERRED EMBODIMENTS OF THE INVENTION

Figure 1:
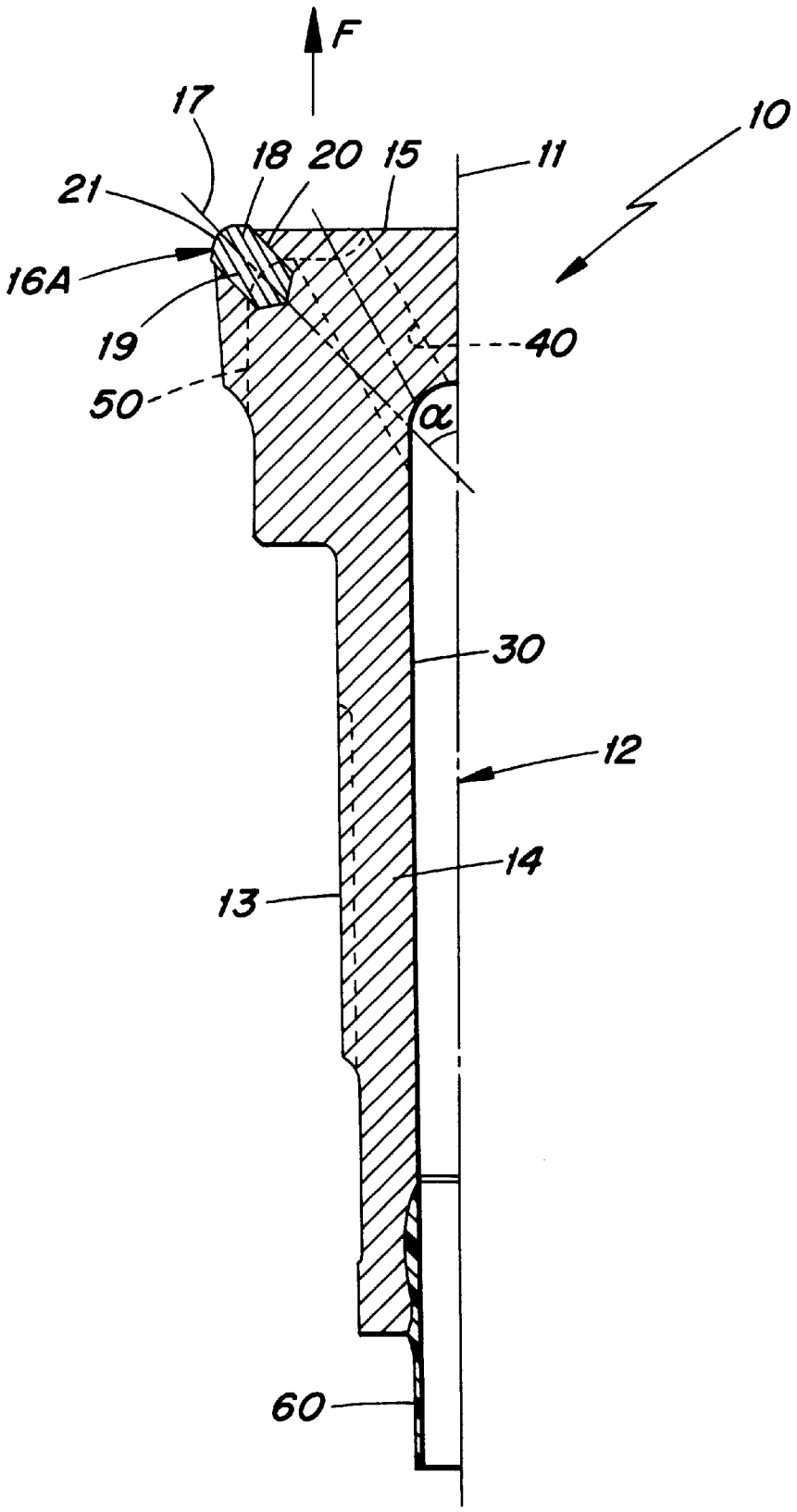
FIG. 1 shows one half of a percussive drill bit according to the present invention in longitudinal section.

In FIG. 1 there is shown one longitudinal half of a drill bit 10 according to the present invention, the bit being generally symmetrical about its rotational center axis 11. The bit comprises a steel drill body 12 which has external splines 13 on the shank 14 thereof. The splines shall be connected to corresponding splines in a driver sub of a down-the-hole hammer, not shown, so as to transfer rotational movement in the usual manner. Alternatively the spline can be replaced by other means, such as threads, for connecting the bit to a drill string, not shown.

The drill bit 10 further includes a central passage 30 for a pressurized medium such as air, connected to an angled fluid passage 40 which is further connected to a chipway or return groove 50. A conventional plastic valve 60 is disposed in the passage 30.

Provided in the front face 15 of the drill body is a number of front button inserts, not shown. The front button inserts are made of cemented carbide and are secured in borings in the front face. The button is shaped symmetrically about its longitudinal center line and can therefore be press fitted or shrink fitted into the drill body 12 means of a standard machine, not shown, i.e. without having to rotate the button to an exact position in the button hole.

Figure 2A:
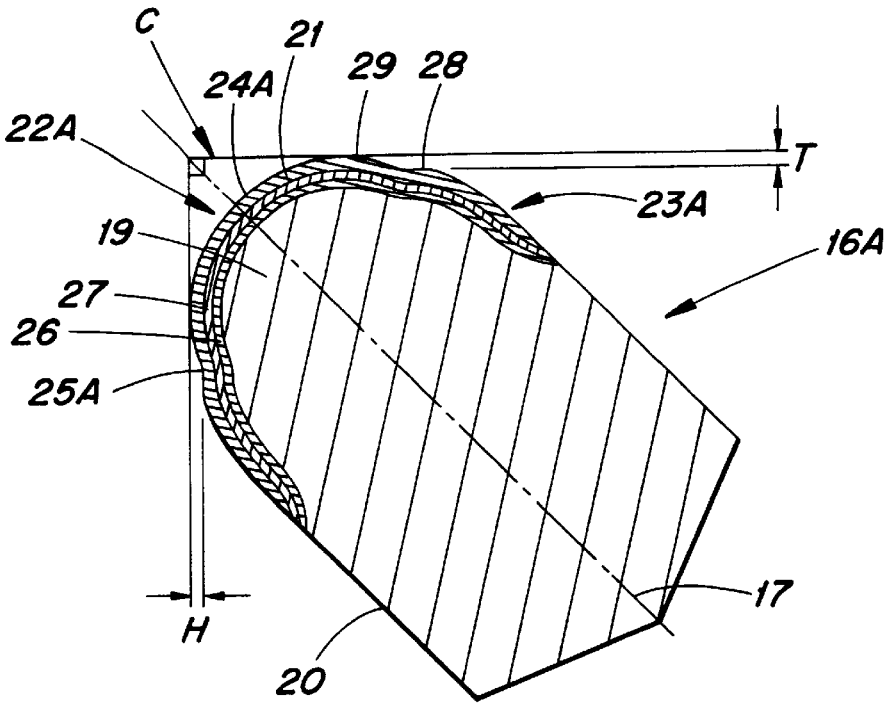
FIG. 2A shows a longitudinal sectional view of a gauge button according to the present invention.
Figure 2B:
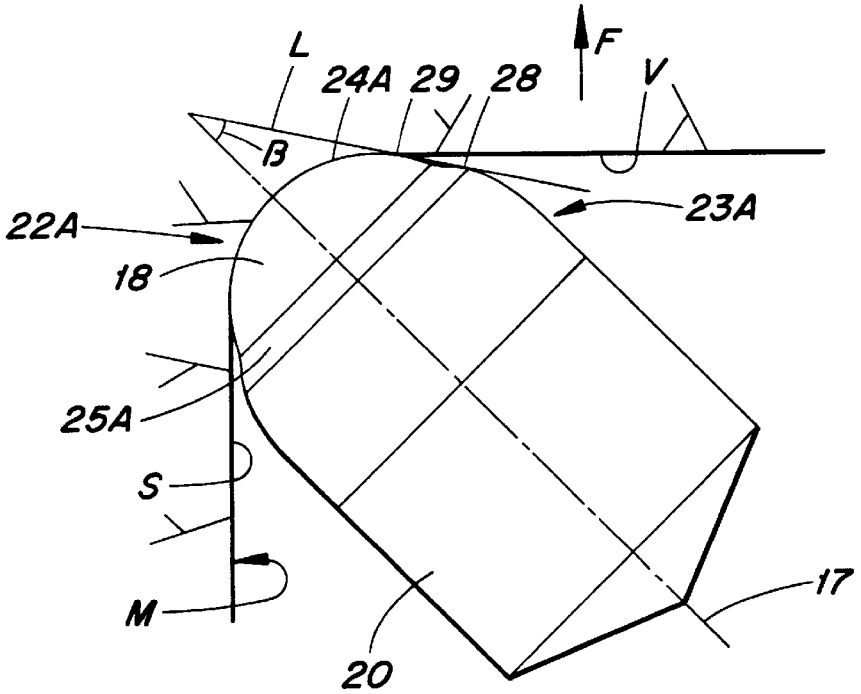
FIG. 2B shows the gauge button of FIG. 2A in a side view, in relation to a bore wall and a bore bottom.

A number of gauge row buttons 16A are positioned around the periphery of the bit 10, the radially outer portions of which buttons 16A define the diameter of the bit and thus the diameter of the bore M being drilled (see FIG. 2B).

The gauge row buttons 16A are tilted in such a way, that a longitudinal center line 17 of each button 16A diverges by an acute angle from the longitudinal center axis 11 of the drill bit in a forward direction of the bit.

Several gauge row buttons 16A may be embedded in the front end of the drill body 12. Each button 16A comprises a cemented carbide body or substrate 19 having a grip portion or mounting portion 20 embedded in the drill body and a front converging end protruding from the drill body to define a crushing end thereof. A polycrystalline diamond layer 21 can be provided on the converging end of the cemented carbide body, whereby the diamond layer would define the crushing end 18 of the button. The longitudinal center axis 11 of the drill bit and the longitudinal center line 17 of the buttons 16A include the angle therebetween. The angle is in the range of about 35°–55°, preferably about 45°.

So far the detailed description of the present invention substantially adheres to the teachings of prior art such as disclosed in U.S. Pat. No. 5,575,342, which is incorporated herein by reference.

However, while the crushing ends of prior art buttons normally are semi-spherical or ballistical, the presently claimed button discloses a sculptured profile, FIGS. 2A–5B. In the buttons of FIGS. 2A–5B according to the present invention, the forward end of the cemented carbide substrate 19 is sculptured so that if a PCD-layer is applied thereupon it will be sculptured too.

Figure 2C:
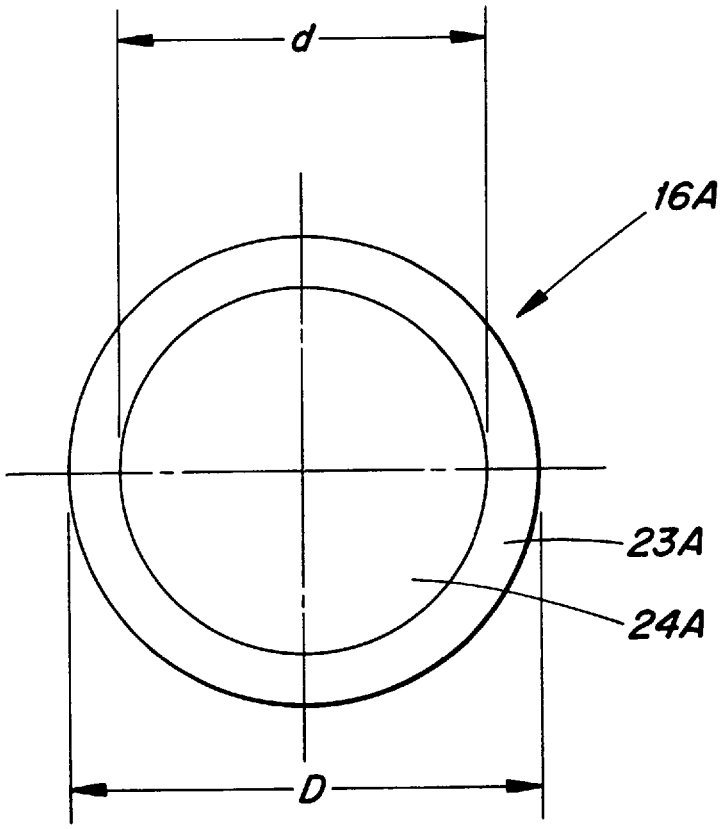
FIG. 2C shows the gauge button of FIG. 2B in top view.

As a result, the front crushing end 18 of the button 16A in FIGS. 2A, 2B and 2C comprises first 22A and second 23A wear zones spaced axially apart by an endless annular groove 25A oriented coaxially with respect to the center line 17. The first wear zone 22A comprises a substantially semi-spherical tip surface or pilot button 24A. The second wear zone 23A follows a convex preferably parabolic path. The first 22A and second 23A wear zones are axially spaced by the annular groove 25A which continuously connects to said wear zones. The annular groove 25A thereby defines, in a longitudinal cross-section of FIG. 2A, local maximum points 28, 29 which are touched by straight imaginary line L, FIG. 2B. The line L defines a second acute angle β relative to the center line 17 of the button. The second angle β is smaller than the first acute angle . An imaginary cone C having a cone apex of 90° touches the first wear zone 23A of the crushing end at a position forwardly of the groove 25A in the feed direction F. This button shape can be used for non-enhanced buttons of ordinary cemented carbide. The effect is then not as distinct as for diamond layered buttons, i.e. as for buttons with a cemented carbide substrate having one or more PCD-layers on the crushing end.

The button is positioned in such a way, normally with the inclination relative to the bit center axis 11 between 35 and 55°. If the angle is 45°, the crushing end will be worn at about 45° relative to the center line 17 of the button either on only one side of the crushing end, for example on the side flank which faces towards and hits the side S of the hole being drilled, or also on the front flank which faces and hits the bottom V of the hole being drilled, i.e., in the drilling direction F.

In the preferred embodiments of the present invention there is at least one diamond layer 21 disposed on the front end 18 of the cemented carbide body. Other layers 26, 27 could be provided if desired. The PCD-top-layer 21 has very high wear resistance while an underlying transition layer 27 is less wear resistant. When the pilot button 22A has worn through the hard and wear resistant first PCD-top layer 21 and exposes the softer, less wear-resistant, transition layer 27, the second wear zone 23A, with a still intact outer PCD-layer, gradually takes over the wear protective part for the button. Even if the first PCD-layer 21 of the pilot button 22A is worn through, this worn-through part of the button still gives some support to the second wear zone 23A of the button. The thickness of the wear resistant PCD top-layer 21 can be constant and chosen in the interval of 0.2 to 0.6 mm. The thickness might alternatively vary between 0.2 and 0.6 mm in the most subjected parts of the button i.e. at surfaces inclined at an angle between 35 and 55°, preferably at 45°, relative the button axis 17.

The two curved wear zones 22A and 23A are geometrically profiled such that the pilot button or first wear zone 22A protrudes farther than the second wear zone 23A towards the hole side wall M (by a distance H) and the hole bottom V (by a distance T), when the button is used at an angle of about 45 degrees relative to the bit axis. Preferably, the protrusions H and T are at least as big as the thickness of the wear resistant PCD top-layer 21, i.e., H and T are at least 0.4 mm if the PCD top layer 21 is 0.4 mm thick.

Figure 3B:
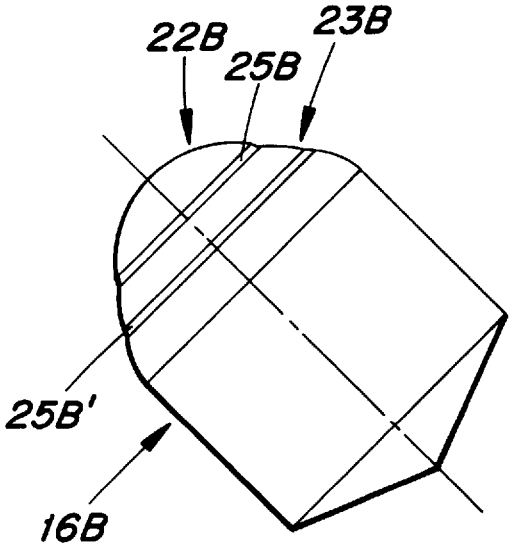
FIG. 3B shows the gauge button of FIG. 3A in a side view.
Figure 4:
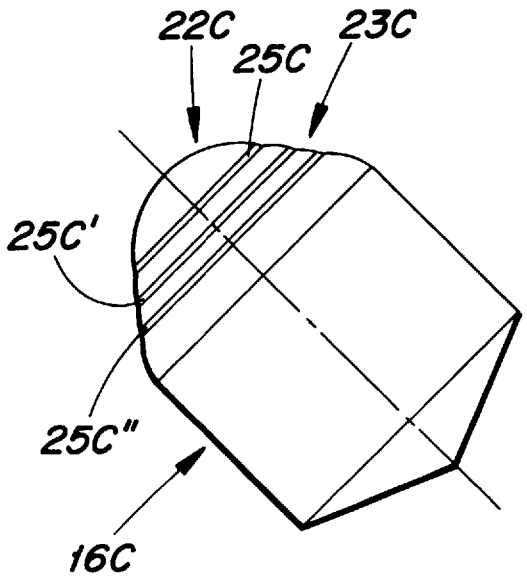
FIG. 4 shows an alternative embodiment of a gauge button according to the present invention in a side view.
Figure 3A:
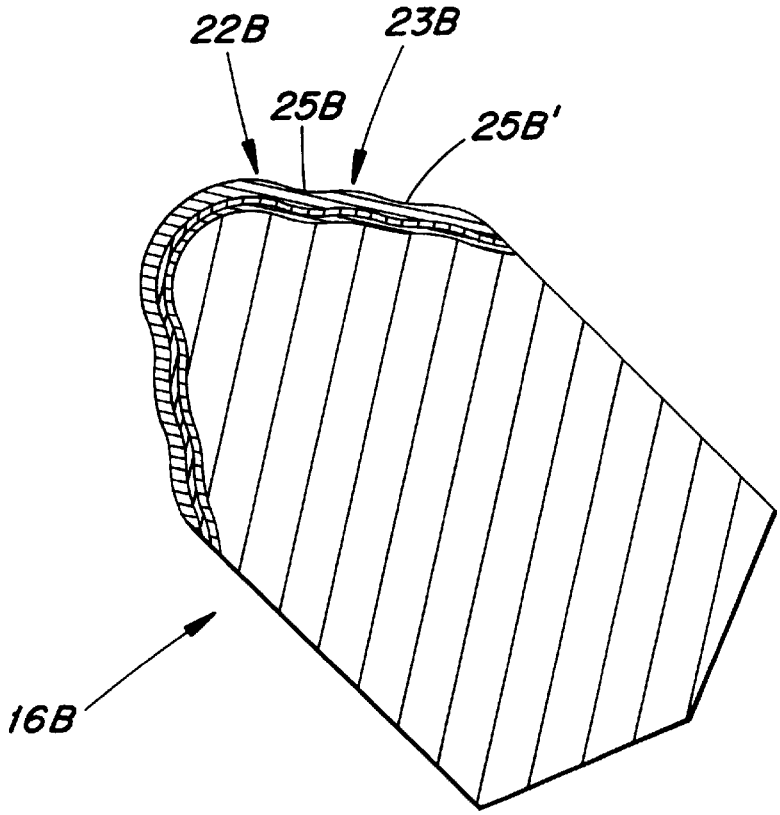
FIG. 3A shows a longitudinal sectional view an alternative embodiment of a gauge button according to the present invention.
Figure 3C:
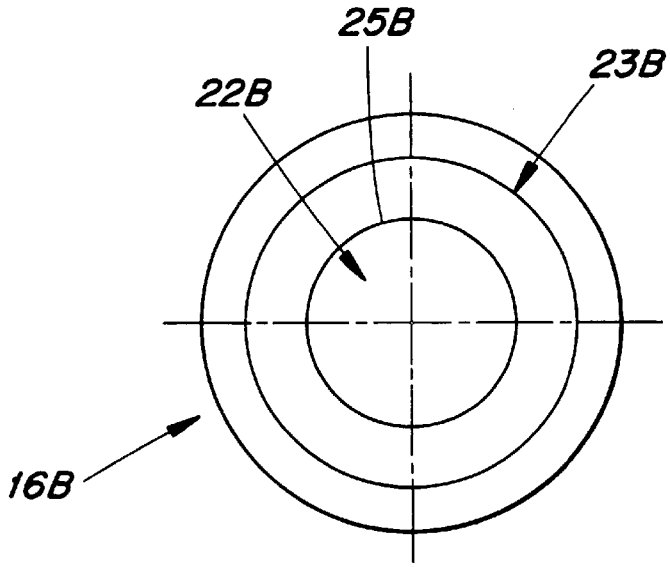
FIG. 3C shows the gauge button of FIG. 3B in top view.
Figure 5A:
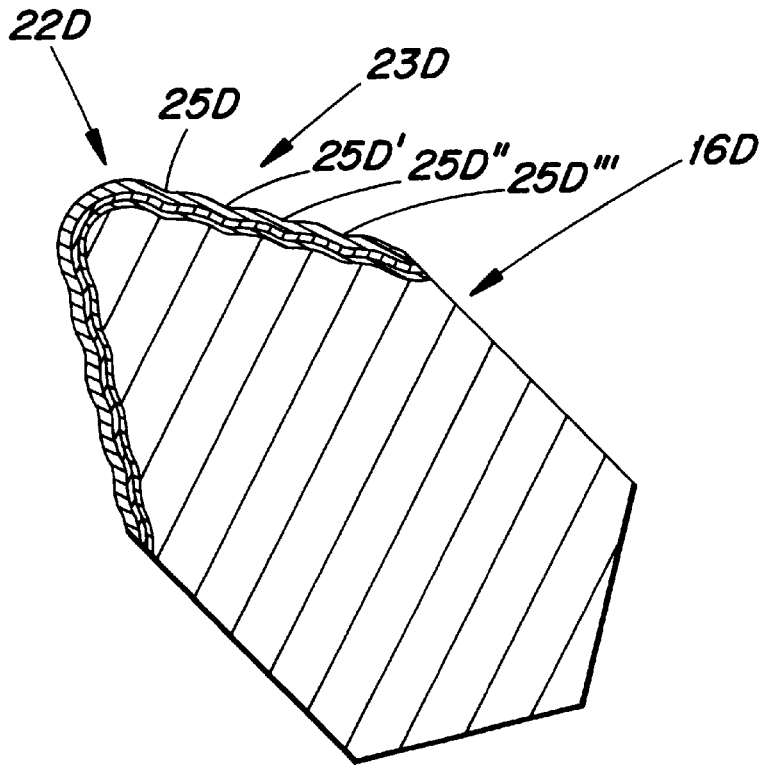
FIG. 5A shows an alternative embodiment of a gauge button according to the present invention in a longitudinal sectional view.
Figure 5B:
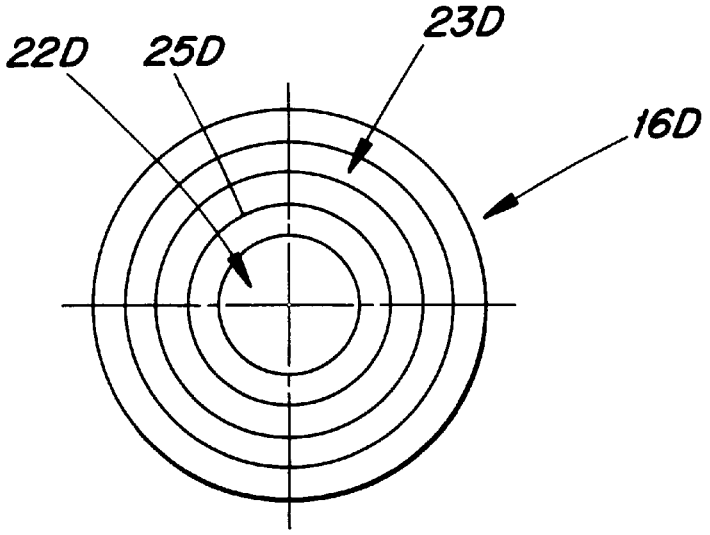
FIG. 5B shows the gauge button of FIG. 5A in top view.

In the embodiments of FIGS. 3A–5B buttons 16B, 16C and 16D are shown having more than one annular groove defining local maximum points (i.e., two grooves 25B, 25B' in FIGS. 3A–3C; three grooves 25C, 25C', 25C" in FIG. 4; four grooves 25D, 25D', 25D", 25D'" in FIGS. 5A, 5B). Still the first wear zone 22B–22D constitutes a kind of pilot button in use and the second wear zone 23B–23D around the pilot button is constituted by two or more annular segments. One part of the PCD-layer of the button is taking most of the work against for example the bore wall in an initial part of the service life of the button and another area (and optionally a third and a fourth, etc. area) of the button is activated when the first, second etc. areas more or less have worn through the hard PCD-layer to expose softer transition layers. In that way the total wear resistance for the button is increased compared with a standard type of button tip design, i.e. a semispherical tip. Thus the PCD-layer can endure a longer time of service than conventional DE-buttons with shapes such as semispherical, ballistical, or the like.

The drill bit according to the present invention can be used for percussive drilling or rotary drilling preferably for top hammer drilling or any other type of percussive drilling such as drifter drilling and long hole drilling in any type of rock preferably in hard to very hard abrasive rock that have DE gauge buttons mixed with cemented carbide-buttons and preferably DE-buttons in the gauge row and DE-buttons or cemented carbide buttons in the front end. The button can be placed at any position of a bit where this wear type occurs. Often this position is at the gauge button positions but it could as well be at front button positions of the bit, especially if the bit has a drop center shape or strong convex shape or double heel row.

If still another annular segment is located radially outside the first annular segment the protrusion of the former is reduced by a distance H relative to the rotational axis 11 of the bit which is at least equal to the thickness T of the wear resistant PCD top-layer. That is, the distance H is at least 0.4 mm when the thickness of the wear resistant PCD top-layer is 0.4 mm.

If still second, third etc. annular segments are located radially outside each other the protrusion of each annular segment is at least 0.4 mm smaller than the closest preceding annular segment if the wear resistant PCD top-layer is 0.4 mm.

The cemented carbide substrate can be turned in a lathe or formed in a press. The base diameter d of the central pilot button 24A–24D can be from ⅙ to 9/10 of the button diameter D. The button 16A, 16B, 16C is completely symmetrical about its center line 17.

The shape can also be used for dual phase buttons or ordinary cemented carbide buttons. The effect of the latter is not as big as for diamond.

The button is sharper than a comparable semispherical button with the same total diameter and has therefore better penetration rate in most rock types.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drill bit comprising a drill body having a connection section at a rear end thereof for connection to a drilling unit, and defining a rotational center axis of the drill bit, and a plurality of buttons embedded in a front end of the drill body, each button having a longitudinal center line, each button comprising a cemented carbide body having a rear mounting portion embedded in the drill body, and a crushing end protruding from the drill body and being shaped symmetrically about the center line, each button oriented at a first acute angle relative to the rotational center axis of the drill bit, the first acute angle being from about 35° to about 55°, the crushing end of each button comprising at least one annular groove arranged coaxially about the center line whereby the crushing end includes local maximum points spaced axially apart by the groove, an imaginary line touching the maximum points defining a second acute angle relative to the center line of the button, the second acute angle being smaller than the first acute angle.

2. The drill bit according to claim 1, wherein the crushing end of each button is configured such that an imaginary cone having a cone apex of 90° touches a portion of the crushing end located forwardly of said groove in a feed direction of the bit.

3. The drill bit according to claim 1, wherein there is at least one diamond layer disposed on the crushing end of the carbide body, first and second segments of the diamond layer determining the maximum points.

4. The drill bit according claim 1, wherein a number of the annular grooves is provided in axially spaced relationship, the grooves bordering several annular segments of generally parabolic geometry, and wherein a second annular segment is located radially outside a first segment when seen in a side view of the button.

5. A drill bit according to claim 4, wherein the number of annular segments is up to five.

6. A drill bit according to claim 1, wherein the buttons comprise gauge buttons of the drill bit.

7. A button for a drill bit, comprising a cemented carbide body having a rear mounting portion defining a longitudinal center line, and a crushing end arranged symmetrically about the center line, the crushing end of the button comprising at least one annular groove arranged coaxially with the center line, whereby the crushing end includes local maximum points spaced axially apart by the groove, an imaginary line touching the maximum points defining an acute angle relative to the center line.

8. The button according to claim 7, wherein the crushing end is configured such that an imaginary cone having a cone apex of 90° touches a first portion of the crushing end forwardly of the groove.

9. The button according to claim 7, wherein there is at least one diamond layer disposed on the crushing end of the carbide body, first and second segments of the diamond layer determining the maximum points.

10. The button according to claim 7, wherein a number of the annular grooves is provided which define several annular segments of generally parabolic geometry.

11. The button according to claim 10, wherein the number of annular segments is up to 5.

* * * * *